US008403244B2

(12) United States Patent
Young et al.

(10) Patent No.: US 8,403,244 B2
(45) **Date of Patent: *Mar. 26, 2013**

(54) MOBILE SYSTEM AND METHOD FOR CRUSHING ROCK WHILE ISOLATING ELECTRONIC COMPONENTS FROM EXCESSIVE VIBRATION

(75) Inventors: Gregory Young, Cedar Rapids, IA (US); Richard Sadler, Anamosa, IA (US); Dan Garland, Iowa City, IA (US)

(73) Assignee: Terex USA, LLC, Wilmington, DE (US)

( * ) Notice: Subject to any disclaimer, the term of this patent is extended or adjusted under 35 U.S.C. 154(b) by 78 days.

This patent is subject to a terminal disclaimer.

(21) Appl. No.: 13/172,455

(22) Filed: Jun. 29, 2011

(65) Prior Publication Data

US 2011/0253816 A1 Oct. 20, 2011

Related U.S. Application Data

(63) Continuation of application No. 12/100,939, filed on Apr. 10, 2008, now Pat. No. 7,992,814.

(51) Int. Cl.
*B02C 1/10* (2006.01)
*B03B 7/00* (2006.01)

(52) U.S. Cl. ..... 241/101.2; 241/101.76; 241/207

(58) Field of Classification Search ..... 241/207, 241/101.2, 101.78

See application file for complete search history.

(56) References Cited

U.S. PATENT DOCUMENTS

| | | | | |
|---|---|---|---|---|
| 3,899,091 | A | 8/1975 | Smith | |
| 4,371,304 | A | 2/1983 | Smith | |
| 4,441,415 | A | 4/1984 | Hawkins | |
| 4,655,402 | A * | 4/1987 | Desourdy | 241/76 |
| 4,783,986 | A | 11/1988 | Koshelev | |
| 5,161,744 | A * | 11/1992 | Schoop et al. | 241/101.74 |
| 5,341,727 | A | 8/1994 | Dickson | |
| 5,368,242 | A | 11/1994 | Fish | |
| 5,490,635 | A * | 2/1996 | Gray | 241/101.76 |
| 6,058,632 | A | 5/2000 | Hawkins | |
| 6,280,119 | B1 | 8/2001 | Ryan et al. | |
| 6,668,712 | B1 | 12/2003 | Gervais | |
| 6,835,041 | B1 | 12/2004 | Albert | |
| 6,935,587 | B2 | 8/2005 | Brock et al. | |
| 7,264,190 | B2 | 9/2007 | Smith et al. | |
| 2006/0037845 | A1 | 2/2006 | Yoshimura et al. | |

* cited by examiner

*Primary Examiner* — Bena Miller

(74) *Attorney, Agent, or Firm* — Simmons Perrine Moyer Bergman PLC

(57) ABSTRACT

A mobile rock crushing vehicle with a detachable electronic control box which can be automatically lifted, by a pair of hydraulic pivoting arms, off the vehicle, lowered and set upon any vibration damping and isolating mass, such as the earth, all by moving a hydraulic lever. The pair of pivoting arms further automatically configures a reduced-vibration transmitting connection when the electronic control box is set upon the ground.

19 Claims, 8 Drawing Sheets

MOBILE SYSTEM AND METHOD FOR CRUSHING ROCK WHILE ISOLATING ELECTRONIC COMPONENTS FROM EXCESSIVE VIBRATION

FIELD OF THE INVENTION

The present invention generally relates to mobile rock crushers with electronic component vibration reduction mechanisms. It should be noted that any vehicle with high amplitude low frequency vibrations similar to the vibrations of a rock crusher could benefit from the present invention.

BACKGROUND OF THE INVENTION

In recent years, advancements in rock crusher controls have involved utilization of more complex electronics. However, this has also increased the concern for reducing the vibration experienced by electronic or other shake-sensitive components of such mobile rock crushers. Some designs have been improved by isolating the electronic control box or panel of the rock crusher from vibration. The high amplitude, low frequency vibrations generated by the crusher can cause problems with the electronic components inside the box. The fine wires mounting components inside the electronic devices can break due to fatigue and over time, can cause equipment shut-down conditions.

In the past, shock-absorbing mounts have been attempted to separate the control box from rigid structure on the mobile crusher. Because of the large amplitude of these vibrations, these mounts have been generally quite soft. While soft mounts can effectively reduce the vibration transmitted to the electric control box, they lead to instability on the highway as the control boxes may weigh around 1000 lbs or more with certain crusher designs. Having a 1000-lb package elevated above the ground and mounted on very soft mounts is less than optimal.

It is becoming common for crushing plant manufacturers to recommend that sensitive electronics be removed when the crusher is in operation. Recently, crusher manufacturers have employed a removable electronic control panel which is taken off the vehicle and placed on the adjacent surface of the ground. The ground acts to dampen the vibrations from the rock crusher and isolate the electronic control panel.

Common practice for many operators of crushing plants is to use an end loader to lift the electrical control panel or cabinet from a mounting position on the plant/vehicle and lower it to the ground. This often means the operator ties a chain, strap, cable, or other device to lifting eyes mounted to the top of the cabinet and the bucket of the loader. Once the panel is lifted from the mounting brackets on the plant, there are usually no guides to hold it in position (keep from twisting, etc). This can result in difficult handling and damage to the cabinet, wiring, or plant due to the tight clearances and "lack of finesse" associated with the loader controls. Because of these problems, some crusher operators resort to simply ignoring the recommendation to remove the panel from the plant during operation.

One improvement to the loader lift idea has been a special purpose crane boom built by James W. Bell Manufacturing of Cedar Rapids, Iowa. This device may hold two electrical cabinets side by side. A hydraulic cylinder extends and retracts to raise and lower the cabinet, but the swing toward and away from the plant is manual. It may employ a "loose" (chain, etc.) mount between the boom/arm and the cabinet to isolate vibration from the plant.

While removing the electronic control panel and placing it on the ground to enhance vibration isolation has been used successfully in the past, numerous problems exist with prior art removable electronic control boxes. The approach using a front end loader with a chain to lift the electronic control box off the vehicle and lower it to the ground has numerous drawbacks, including the need to have a front end loader available, as well as a skilled front end loader operator. While the James W. Bell unit has eliminated the need for a front end loader, it now requires a person to swing the electric box away from the vehicle. This involves pushing on the electrical box after it is lifted and is free to swing about. This step creates an opportunity for a personal injury or damage to the plant to occur by placing a person next to a 1000-lb elevated and swinging object. This design and others may require extra care during deployment to take up and let out extra electrical cabling which extends between the mobile rock crusher and the electronic control box.

Consequently, there exists a need for improved methods and systems for offloading an electrical control box from a mobile rock crusher, which simultaneously provides for increased safety and speed of downloading.

SUMMARY OF THE INVENTION

It is an object of the present invention to provide a system and method for offloading an electronic control box from a mobile rock crusher.

It is a feature of the present invention to provide a single action or single motion hydraulic actuator for lifting the electronic box of the vehicle, moving it away from the vehicle and lowering it to the ground.

It is still another feature of the present invention to include a continuous electrical connection between the electronic control box, while reducing the need for extra cable which potentially creates problems during deployment.

It is yet another feature to include an adjustable foot stop mechanism to keep the electronic control box stable while in the transport position.

It is an advantage of the present invention to provide for a single motion for lifting and securing an electronic control, thereby increasing the speed of downloading an electronic control box from a mobile rock crusher and decreasing the risk of personal injury to humans involved in the offloading process, while eliminating the need for a cable winch and limiting the amount of extra cabling required to facilitate the offloading.

The present invention is a system and method for offloading an electronic control panel from a mobile rock crusher which is designed to satisfy the aforementioned needs, provide the previously stated objects, include the above-listed features, and achieve the already articulated advantages.

Accordingly, the present invention is a system and method which includes a mobile rock crusher with a hydraulically actuated dual boom system which is configured for operation with a single continuous motion.

BRIEF DESCRIPTION OF THE DRAWINGS

The invention may be more fully understood by reading the following description of the preferred embodiments of the invention, in conjunction with the appended drawings wherein.

DETAILED DESCRIPTION

The following description is focused upon the system and method of the present invention in association with electronic control boxes and mobile rock crushing equipment because it is believed that the advantage of the present invention would be readily apparent in such situations. However, the present invention is not intended to be so limited. The beneficial aspects of the present invention could be desirable for other construction equipment which has high amplitude low frequency vibration characteristics and for other equipment or structures besides electronic control boxes which have need for vibrational damping during operation of the equipment.

Figure 1:
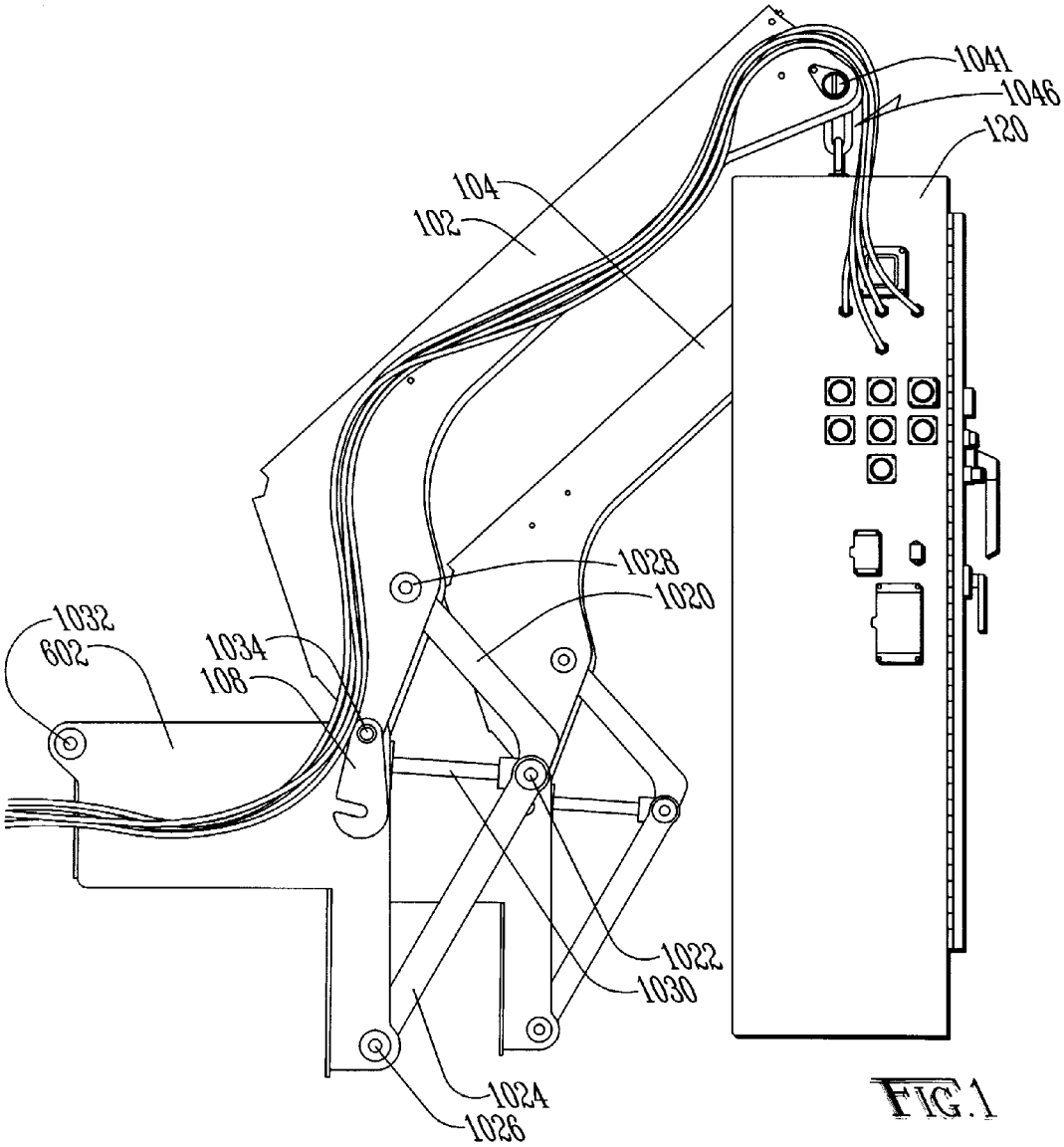
FIG. 1 is a perspective view of the mobile rock crusher of the present invention with the electronic control box at an intermediate stage in the process of being offloaded.
Figure 8:
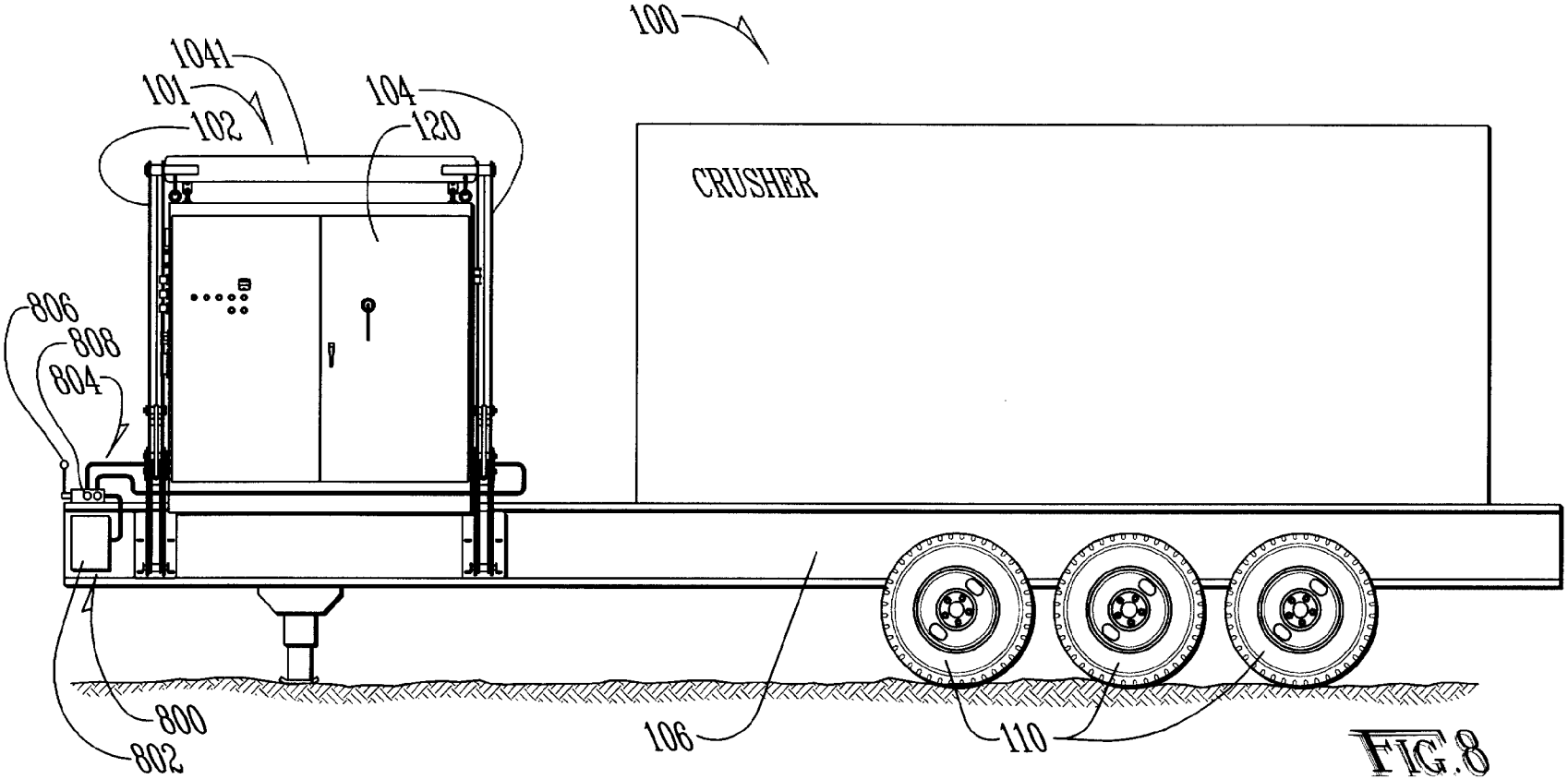
FIG. 8 is a schematic sketch of the mobile rock crusher of the present invention which includes a block diagram depiction of the control system for the pivoting boom structures.

Now referring to the drawings wherein like numerals refer to like matter throughout, and more specifically referring to FIGS. 1 and 8, there is shown a mobile rock crusher 100 with an electronic control box 120. Mobile rock crusher 100 shows a cone crusher, but a jaw crusher or impact rock crusher could be used to crush rock, concrete or other aggregate-type material as well.

The electronic control box 120 is shown as a cabinet-like container for housing an electronic control, which may include components whose longevity can be adversely affected in a high amplitude low frequency vibration or shock environment. The electronic control box 120 is shown coupled to the cone crusher via several large electric cables from each side of the electronic control box 120. Also shown is mobile rock crusher trailer structure 106 and mobile rock crusher wheels 110. Mobile rock crusher 100 could be constructed to be independently moveable on tracks, and could be made either with or without a trailer arrangement. A first pivoting boom arm mechanical lock 108 is also shown for latching the electronic control box 120 in a stowed position for transport. The various components can be made of suitable materials, but steel may be preferred. The first pivoting boom main arm 102 and second pivoting boom main arm 104 must be constructed to carry the load of the electronic control box 120 which could weigh 1000 pounds or more.

The electronic control box 120 is shown suspended from above by first pivoting boom main arm 102 and second pivoting boom main arm 104. First pivoting boom main arm 102 is shown having a first pivoting boom arm upper connecting member 1020 and a first pivoting boom arm central pivot point member 1022. Second pivoting boom main arm 104 is constructed in a like manner to first pivoting boom main arm 102. Second pivoting boom main arm 104 could be identical in construction and be a simple translation in position. A mirrored relationship could exist between first pivoting boom main arm 102 and second pivoting boom main arm 104.

Figure 2:
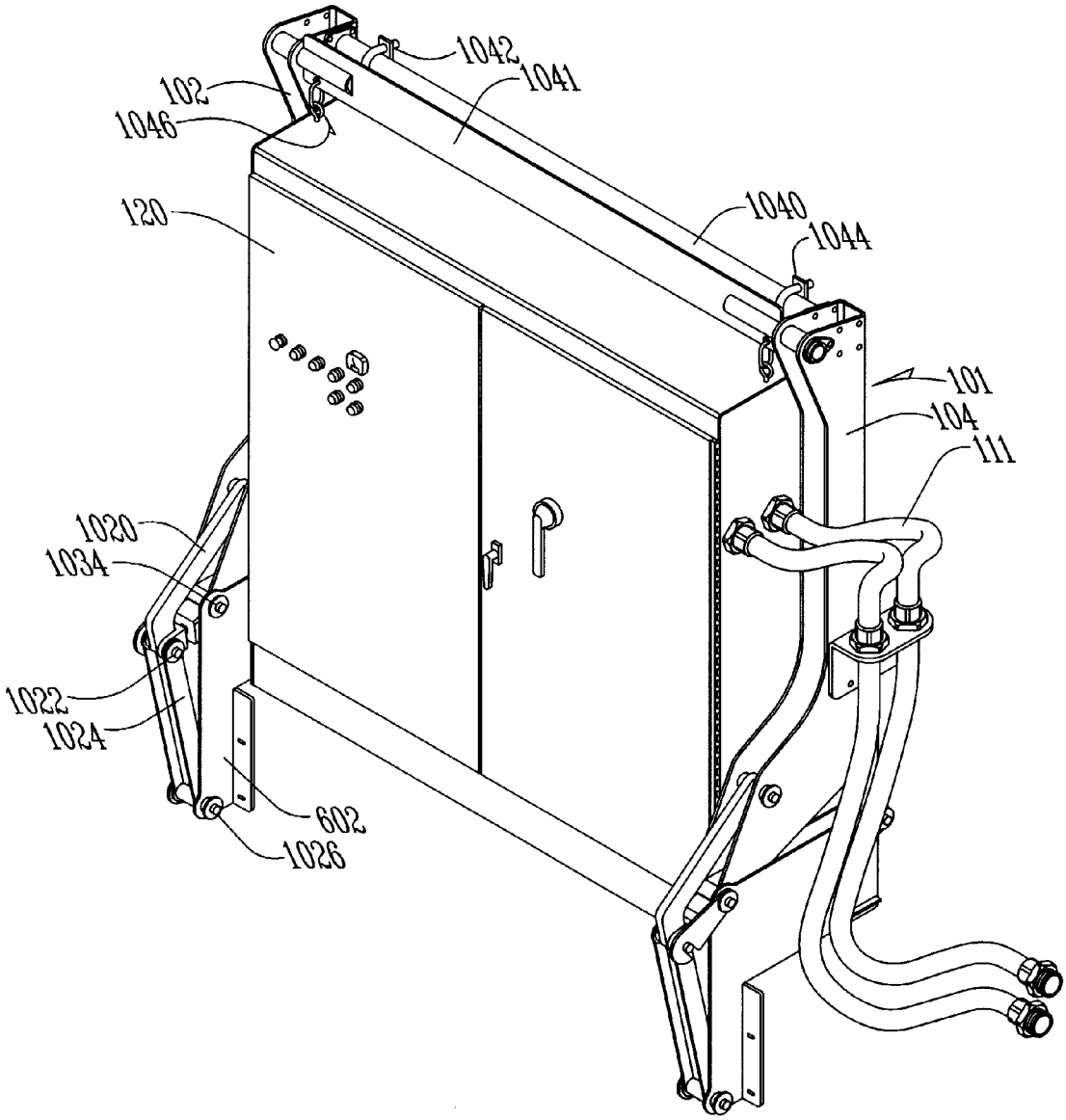
FIG. 2 is a perspective view of the electronic control box and the pivoting boom structure, where the electronic control box is disposed in a stowed position for transportation.

Now referring to FIG. 2, there is shown a drawing of the electronic control box 120 in a stowed position on the mobile rock crusher trailer structure 106 for transport. The first pivoting boom stationary end pivot point member 1034 can be seen, as well as the first pivoting boom adjustable foot stop 1042 and the second pivoting boom adjustable foot stop 1044 and the boom connecting rod 1040. Also shown are electric cable or cable conduit 111 which can connect the electronic control box 120 to other equipment on the mobile rock crusher 100. Pivoting control box support 1041 is pivotally coupled to first pivoting boom main arm 102 and second pivoting boom main arm 104, so that the electronic control box 120 pivots freely with respect to both booms 102 and 104.

Figure 3:
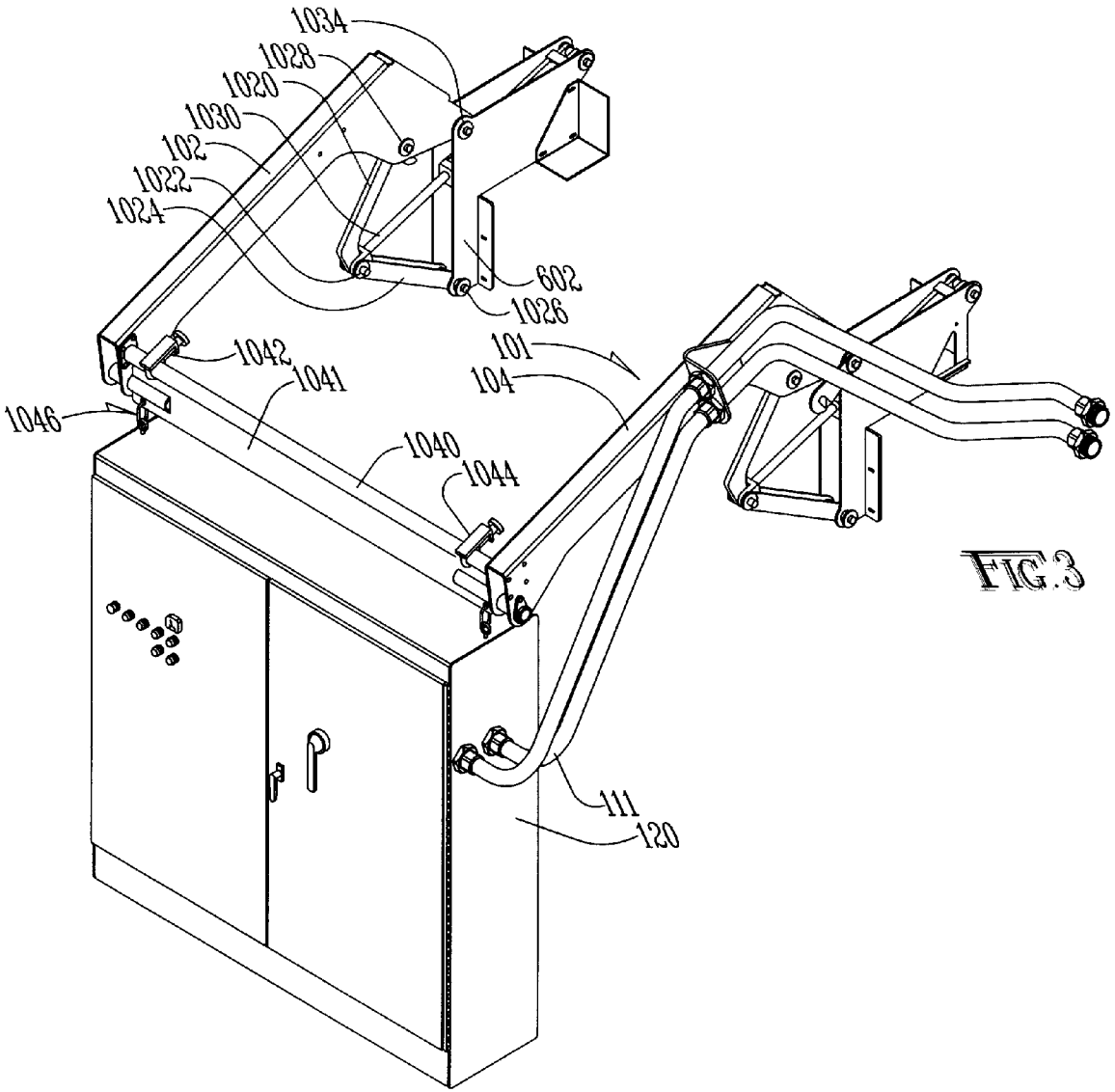
FIG. 3 is a perspective view of the electronic control box and the pivoting boom structure, where the electronic control box is deployed in a ground resting position for operation of the mobile rock crusher.

Now referring to FIG. 3, there is shown the system of the present invention with the electronic control box 120, in a lowered position, such as when it rests upon the earth. Also shown are the first pivoting boom non-rigid connection 1046, which could be a chain, some detachable links, a clevis or the like, or a combination of them. Also shown are first pivoting boom adjustable foot stop 1042 and second pivoting boom adjustable foot stop 1044, each with the adjustable contact pads 11 which can be screw adjusted so as to automatically and precisely apply pressure onto the top surface of the electronic control box 120 when the first pivoting boom main arm 102 and the second pivoting boom main arm 104 lift and place the electronic control box 120 onto the mobile rock crusher 100.

Also shown is the first pivoting boom arm lower connecting member 1024, as well as the first pivoting boom linear actuator 1030 and the first pivoting boom linear actuator pivot only end 1032.

Figure 4:
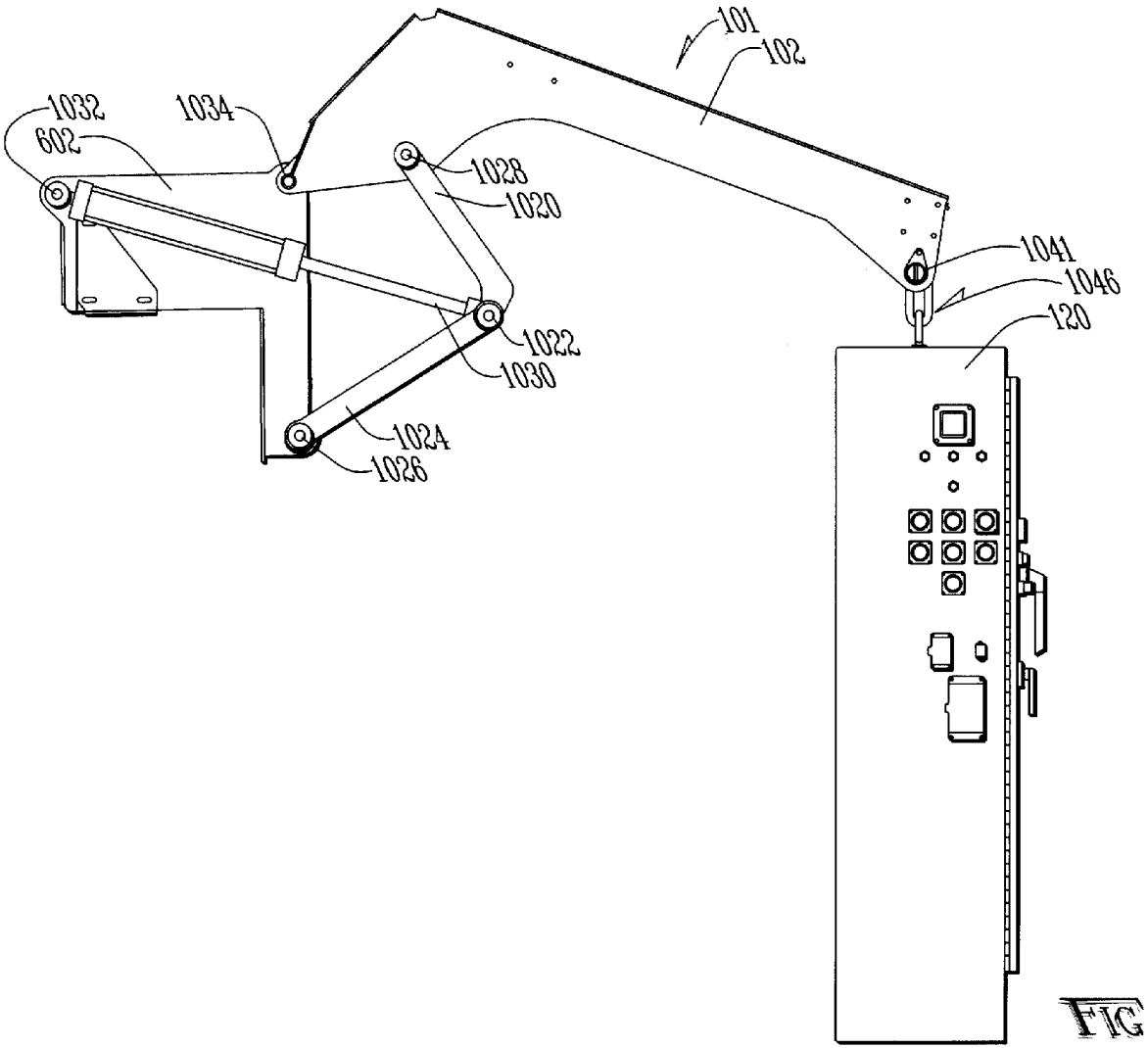
FIG. 4 is an elevation view of the side of the electronic control box and the pivoting boom structure, where the electronic control box is disposed in a ground resting position for operation.

Now referring to FIG. 4, there is shown a side view of the apparatus of FIG. 3 in a deployed position where the electronic control box 120 has been lowered to the ground and where it can be seen that electronic control box 120 is suspended from first pivoting boom main arm 102, which pivots about first pivoting boom stationary end pivot point member 1034 by extension or retraction of first pivoting boom linear actuator 1030, which couples to first pivoting boom arm upper connecting member 1020 and first pivoting boom arm lower connecting member 1024 at first pivoting boom arm central pivot point member 1022. First pivoting boom linear actuator 1030 could be a hydraulic cylinder, a pneumatic actuator, an electro-mechanical or mechanical linear actuator, etc. During storage for transport, the first pivoting boom linear actuator 1030 could be locked in place by a hydraulic locking valve or the like. First pivoting boom linear actuator 1030 has a translating and pivoting portion at first pivoting boom arm central pivot point member 1022 and a first pivoting boom linear actuator pivot only end 1032.

Figure 5:
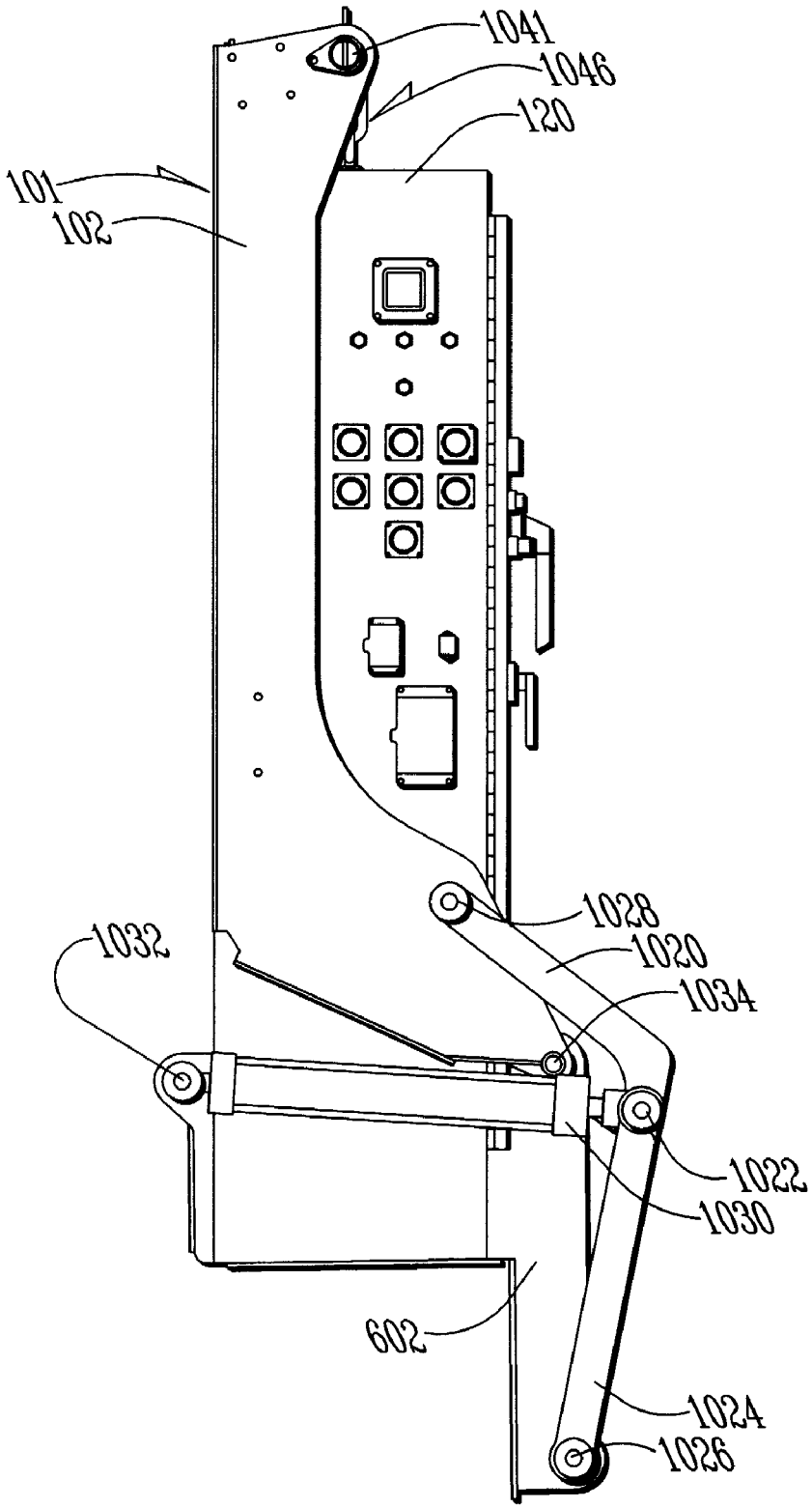
FIG. 5 is an elevation view of the side of the electronic control box and the pivoting boom structure, where the electronic control box is disposed in a stowed position for transportation.

Now referring to FIG. 5, there is shown a side view of the electronic control box 120 similar to FIG. 4, except that the electronic control box 120 is shown in a stowed position for transporting. In FIG. 5, the first pivoting boom linear actuator 1030 is revealed and the first pivoting boom arm lower connecting member pivot only end 1026 is shown. First pivoting boom arm upper connecting member 1020 is shown coupled at the first pivoting boom arm central pivot point member 1022 and at the first pivoting boom main arm to upper connecting member pivot member 1028.

Figure 6:
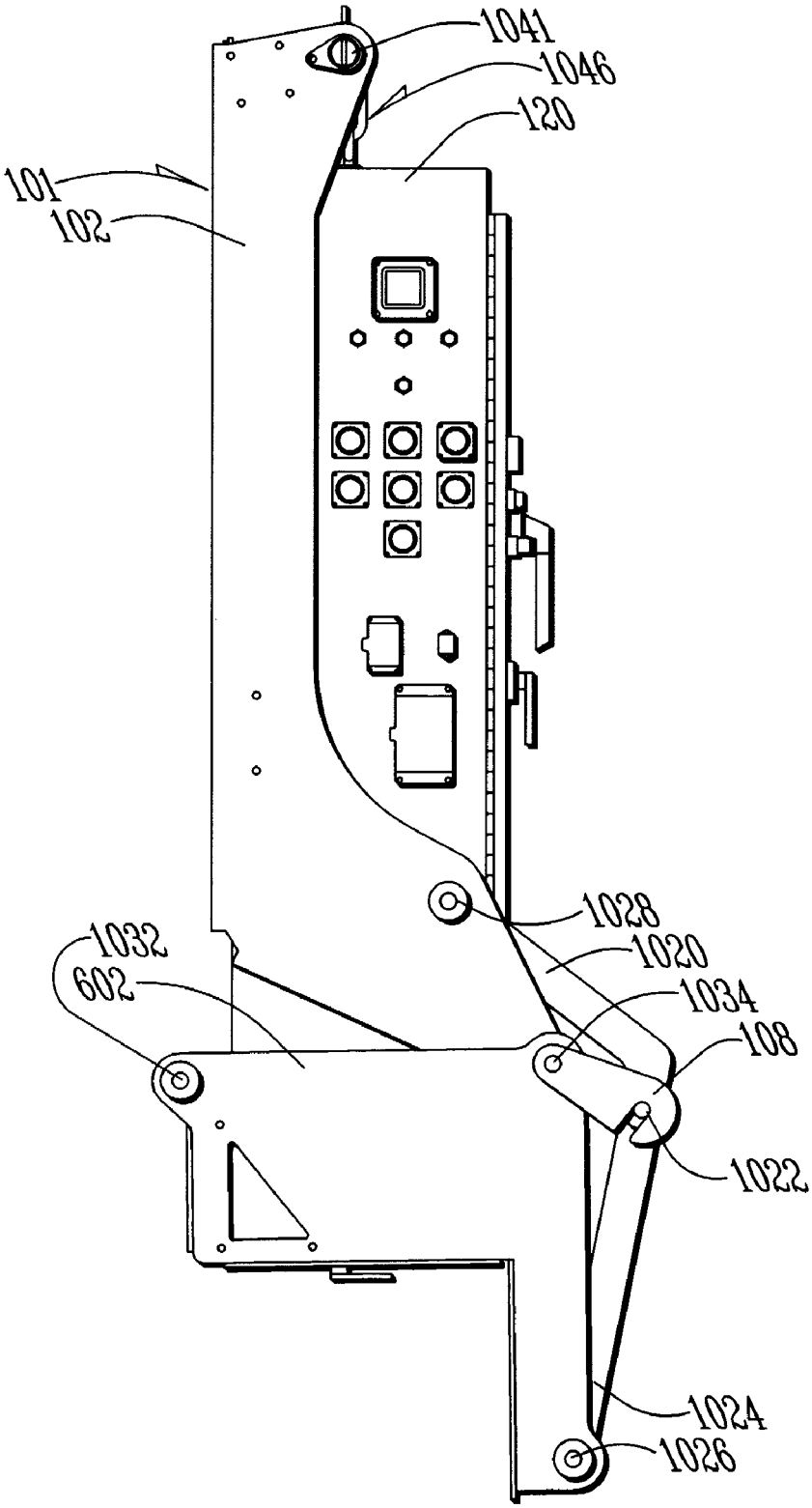
FIG. 6 is an elevation view of the side of the electronic control box and the pivoting boom structure of FIG. 5, where the electronic control box is disposed in a stowed position for transportation, and with a cover plate and a mechanical lock shown thereon.

Now referring to FIG. 6, there is shown the electronic control box 120 of FIG. 5 with the addition of a first boom arm side stationary connection structure 602 and a first pivoting boom arm mechanical lock 108 which couples to a bolt, rod or other protuberance at first pivoting boom arm central pivot point member 1022.

Figure 7:
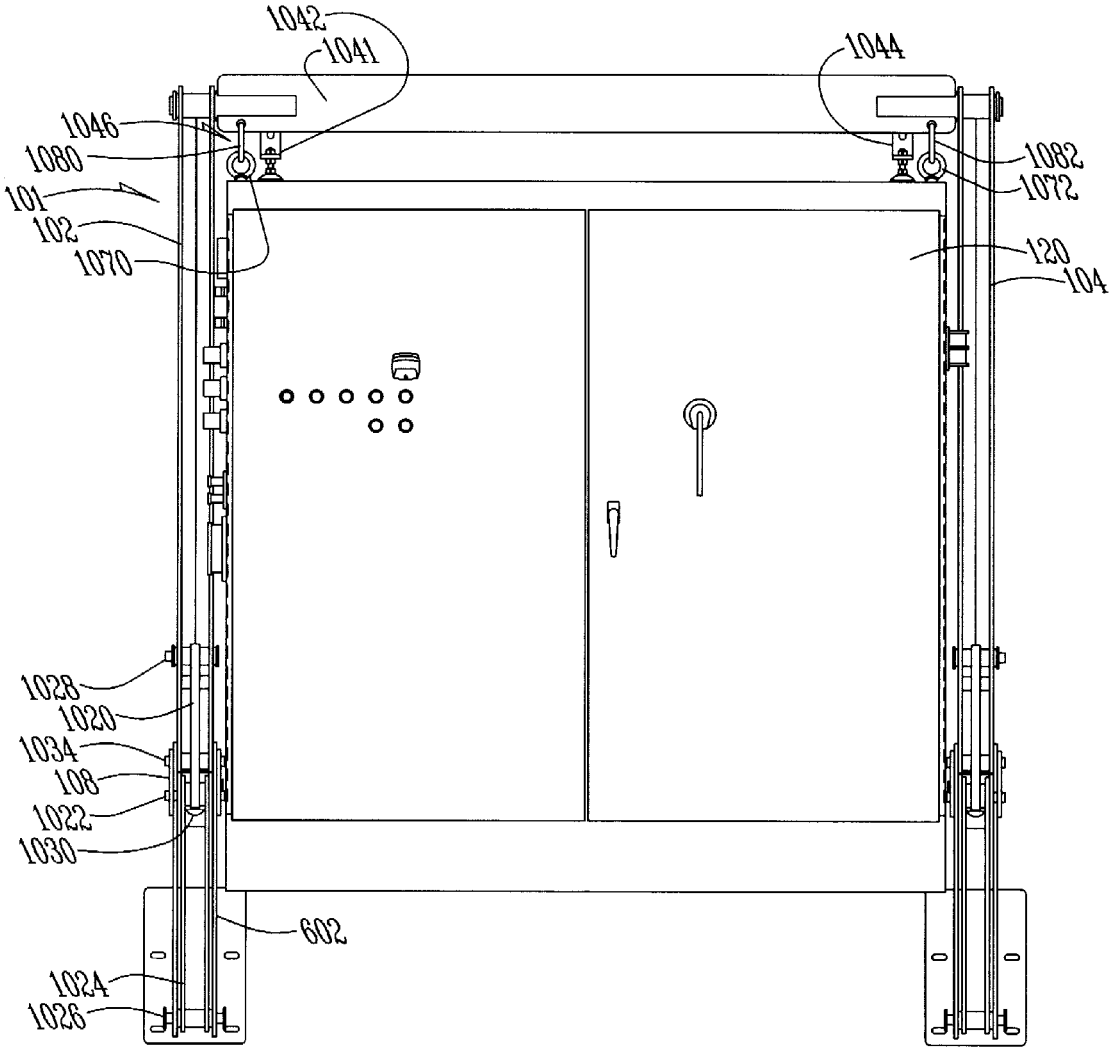
FIG. 7 is an elevation view of the front of the electronic control box and the pivoting boom structure, where the electronic control box is disposed in a stowed position for transportation.

Now referring to FIG. 7, there is shown a front view of the electronic control box 120 of the present invention, also shown in a stowed configuration for transport. Also shown is pivoting control box support 1041, which extends between and pivotally couples to first pivoting boom main arm 102 and second pivoting boom main arm 104, thereby allowing the electronic control box 120 to remain hanging vertically through the various stages of deployment. When first pivoting boom main arm 102 is fully deployed for transport, the first pivoting boom adjustable foot stop 1042 and second pivoting boom adjustable foot stop 1044 come in contact with a top surface of electronic control box 120, thereby creating a restraining force on the electronic control box 120, which helps to reduce movement of the electronic control box 120 relative to the boom connecting rod 1040.

Electronic control box 120 is shown coupled to pivoting control box support 1041 by first boom side upper connection loop 1080 and first boom side lower connection loop 1070, as well as the combination of second boom side upper connection loop 1082 and second boom side lower connection loop 1072.

Now referring to FIG. 8, there is shown the mobile rock crusher 100, including pivoting boom structure 101, as well as boom pivoting control and power system 800, which may include a boom power source 802 and boom control station 804 with a boom control lever 806 and boom control up and down buttons 808. However, a preferred embodiment may have either one of the boom control lever 806 or boom control up and down buttons 808. It should be understood that other types of well-known controls for controlling hydraulic, pneumatic and electric or mechanical actuators could be used. Hydraulic locking valves could be used as well to secure the electronic control box 120 in place with the first pivoting boom adjustable foot stop 1042 and the second pivoting boom adjustable foot stop 1044 when being stored for transport.

DEFINITIONS

The term "rock crusher" is used throughout this description and is intended to be construed in the claims as a mechanism for crushing hard objects, such as rock, concrete, or other aggregate type materials.

The term "vibration transmissibility" is intended to suggest the ability of something to transmit vibrations from one location to another. For example, a taut chain has a high vibration transmissibility, while a slack chain has a lower vibration transmissibility.

The term "coupled" is intended to mean somehow operatively arranged, but not necessarily meaning in direct physical contact.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

We claim:

1. A mobile rock crusher system comprising:

a frame having a longitudinal axis;

wheels coupled to the frame, and configured to allow the frame to roll in a direction parallel to said longitudinal axis;

a rock crusher coupled to said frame;

an electronic control box, having a bottom surface, the electronic control box configured to provide electronic control of said rock crusher;

a first pivoting boom, at least indirectly, coupled to said frame, and configured to provide force for moving said bottom surface of said electronic control box up from an elevated location, in a direction away from said frame, and controllably lowering said electronic control box below the elevated location so as to allow the bottom surface of the electronic control box to be supported by the earth;

a connection mechanically coupling said electronic control box to said pivoting boom; said connection is configured so that said connection supports said electronic control box when said bottom surface is not supported from below and further not supported by the earth; and an actuator configured for causing said first pivoting boom to move, in a first direction of movement, said electronic control box away from the frame, and lower, in a second direction of movement, the electronic control box down to be supported, from below, by the earth; and cause the connection to end support of the electronic control box, all in response to movement of a control member.

2. A mobile rock crusher system of claim 1 wherein the connection is a non-rigid connection.

3. A mobile rock crusher system of claim 1 wherein said actuator is configured for causing said first pivoting boom to move, in a first direction of movement, said electronic control box away from the frame, and lower, in a second direction of movement, the electronic control box down to be supported, from below, directly by the earth; and cause the connection to end support of the electronic control box, all in response to movement of a control member.

4. The mobile rock crusher of claim 1 further comprising:

a second pivoting boom, coupled to said frame, and configured to provide force for lifting said bottom surface of said electronic control box up off an elevated location, automatically moving the electronic control box in a direction away from said frame, and controllably lowering said electronic control box below the elevated location so as to allow the bottom surface of the electronic control box to be supported, from below, directly by the earth; and a member linking the first pivoting boom to the second pivoting boom.

5. The mobile rock crusher of claim 4 wherein said actuator is a first linear actuator.

6. The mobile rock crusher of claim 4 wherein said first linear actuator is a hydraulic cylinder.

7. The mobile rock crusher system of claim 6 further comprising a first pivoting boom arm mechanical lock configured to hold a pivoting boom in place during transportation.

8. A mobile rock crusher system of claim 7 wherein the connection is a plurality of chain links.

9. The mobile rock crusher system of claim 8 where said plurality of chain links comprises a clevis.

10. A mobile rock crusher of claim 4 wherein said member is configured to rotate with respect to said electronic control box during deployment of the electronic control box, said member further comprises a first pivoting boom foot stop which is configured to firmly press against a top surface of the electronic control box only when the electronic control box is being supported at the elevated location.

11. A mobile rock crusher of claim 10 wherein said first pivoting boom foot stop is adjustable by advancing a screw.

12. A mobile rock crusher system comprising:

a mobile frame;

means for crushing rock coupled to said mobile frame;

means for controlling crushing operations of said means for crushing rock;

means for moving said means for controlling crushing operations from an elevated location, in a direction away from said mobile frame, and controllably lowering said means for controlling crushing operations below the elevated location so as to rest upon a mass which tends to isolate the means for controlling crushing operations from vibrations caused by the means for crushing;

means for mechanically coupling said means for controlling crushing operations to said means for moving and for supporting said means for controlling crushing operations at least partially from above when said bottom portion of said means for controlling crushing operations is not supported from below at said elevated location and further not supported from below by a vibration damping mass;

means for controlling moving operations of said means for moving so that said means for moving is further configured to move away from the mobile frame and controllably lower said means for controlling crushing operations all in response to a control movement.

13. A mobile rock crusher system of claim 12 wherein:

said means for crushing rock comprises a cone crusher;

said means for controlling crushing operations of said means for crushing rock comprises a separate detachable electronic control box;

said means for mechanically coupling comprises a means for non-rigidly mechanically coupling; and said means for controlling moving operations comprises a hydraulic control lever.

14. A mobile rock crusher system of claim 12 wherein:

said means for controlling crushing operations of said means for crushing rock comprises a structurally detachable electronic control box; and said means for moving further configured to automatically cause said means for mechanically coupling, once the means for controlling is set upon the vibration damping mass, to move from a configuration of high vibration transmissibility to a configuration of a lower vibration transmissibility.

15. A mobile rock crusher system comprising:

a frame having a longitudinal axis;

wheels coupled to the frame, and configured to allow the frame to roll in a direction parallel to said longitudinal axis;

a rock crusher coupled to said frame;

an electronic control box, having a bottom surface, the electronic control box configured to provide electronic control of said rock crusher;

a first pivoting boom, coupled to said frame, and configured to provide force for moving said bottom surface of said electronic control box from an elevated location, said first pivoting boom further configured for applying force upon the electronic control box in so as to cause the electronic control box to move in a direction away from said frame, and said first pivoting boom further configured for controllably lowering said electronic control box below the elevated location so as to allow the bottom surface of the electronic control box to be supported by the earth;

a connection mechanically coupling said electronic control box to said pivoting boom, said connection is configured so that said connection at least partially supports said electronic control box from above when said bottom surface is not supported from below at said elevated location and further not supported by the earth;

an actuator configured for causing to move;

said first pivoting boom in a first direction of movement;

said electronic control box, in a second direction of movement;

away from the frame, and lower, in a third direction of movement;

the electronic control box down to be supported by the earth;

and further causing the connection to end support of the electronic control box from above; and all in response to movement of a control member.

16. A mobile rock crusher system of claim 15 wherein said connection is a non-rigid connection.

17. The mobile rock crusher of claim 15 further comprising:

a second pivoting boom, coupled to said frame, and configured to provide force for moving said bottom surface of said electronic control box from an elevated location, forcibly moving the electronic control box in a direction away from said frame, and controllably lowering said electronic control box below the elevated location so as to allow the bottom surface of the electronic control box to be supported by the earth; and a member linking the first pivoting boom to the second pivoting boom.

18. A mobile rock crusher system of claim 15 wherein the connection is a plurality of chain links.

19. A mobile rock crusher system comprising:

a mobile frame;

means for crushing rock coupled to said mobile frame;

means for controlling crushing operations of said means for crushing rock;

means for moving said means for controlling from an elevated location, applying a non-human powered force for moving the means for controlling in a direction away from said mobile frame, and controllably lowering said means for controlling below the elevated location so as to rest upon a mass which tends to isolate the means for controlling crushing operations from vibrations caused by the means for crushing;

means for mechanically coupling said means for controlling to said means for moving and for supporting said means for controlling at least partially from above when said bottom portion of said means for controlling is not supported from below at said elevated location and further not supported from below by a vibration damping mass; and means for controlling operations of said means for moving so that said means for moving is further configured to move away from the mobile frame and controllably lower said means for controlling all in response to a control movement in a single direction.

* * * * *